US008794245B1

(12) United States Patent
Scatterday

(10) Patent No.: US 8,794,245 B1
(45) Date of Patent: Aug. 5, 2014

(54) AROMA PACK FOR AN ELECTRONIC CIGARETTE

(71) Applicant: NJOY, Inc., Scottsdale, AZ (US)

(72) Inventor: Mark Scatterday, Scottsdale, AZ (US)

(73) Assignee: NJOY, Inc., Scottsdale, AZ (US)

( * ) Notice: Subject to any disclaimer, the term of this patent is extended or adjusted under 35 U.S.C. 154(b) by 0 days.

(21) Appl. No.: 13/744,176

(22) Filed: Jan. 17, 2013

(51) Int. Cl.
*A24F 13/00* (2006.01)

(52) U.S. Cl.
USPC ..... 131/329; 131/270; 206/236; 206/242

(58) Field of Classification Search
USPC ..... 131/329, 270; 206/236, 242
See application file for complete search history.

(56) References Cited

U.S. PATENT DOCUMENTS

| | | | | |
|---|---|---|---|---|
| 799,844 | A | 9/1905 | Fuller | |
| 1,299,162 | A | 4/1919 | Fisher | |
| 1,552,877 | A * | 9/1925 | Phillipps et al. | 239/53 |
| 1,632,335 | A | 6/1927 | Hiering | |
| 1,706,244 | A | 3/1929 | Meyerson | |
| 1,845,340 | A | 2/1932 | Ritz | |
| 1,972,118 | A * | 9/1934 | McDill | 312/31.2 |
| 1,998,683 | A * | 4/1935 | Montogomery | 239/34 |
| 2,031,363 | A | 2/1936 | Erikson | |
| 2,231,909 | A | 2/1941 | Hempel | |
| 2,460,427 | A | 2/1949 | Musselman et al. | |
| 2,483,304 | A | 9/1949 | Vogel | |
| 2,765,949 | A | 10/1956 | Hillman | |
| 2,897,958 | A | 8/1959 | Tarleton | |
| 3,420,360 | A | 1/1969 | Young | |
| 3,861,523 | A | 1/1975 | Fountain et al. | |
| 4,207,976 | A | 6/1980 | Herman | |
| 4,798,310 | A | 1/1989 | Kasai et al. | |
| 5,123,530 | A | 6/1992 | Lee | |
| 5,605,226 | A | 2/1997 | Hernlein | |
| 5,810,164 | A | 9/1998 | Rennecamp | |
| 5,938,018 | A * | 8/1999 | Keaveney et al. | 206/261 |
| 5,967,310 | A | 10/1999 | Hill | |
| 6,269,966 | B1 | 8/2001 | Pallo et al. | |
| 6,446,793 | B1 | 9/2002 | Layshock | |
| 6,726,006 | B1 | 4/2004 | Funderburk et al. | |
| 8,141,701 | B2 * | 3/2012 | Hodges | 206/268 |
| 8,464,867 | B2 | 6/2013 | Holloway et al. | |
| 2005/0118545 | A1 | 6/2005 | Wong | |
| 2007/0098148 | A1 | 5/2007 | Sherman | |

(Continued)

FOREIGN PATENT DOCUMENTS

| | | | |
|---|---|---|---|
| CN | 101869356 | A | 10/2010 |
| EP | 2325093 | A1 | 5/2011 |
| JP | 2001-165437 | A | 6/2001 |

OTHER PUBLICATIONS

Communication from the International Searching Authority in PCT/US2014/011897 ("Invitation to Pay Additional Fees and, Where Applicable, Protest Fee") mailed Apr. 23, 2014 (6 pages).

(Continued)

*Primary Examiner* — Richard Crispino
*Assistant Examiner* — Dionne Walls Mayes
(74) *Attorney, Agent, or Firm* — Bookoff McAndrews, PLLC

(57) ABSTRACT

The present disclosure generally relates to an aroma pack for electronic cigarettes. The aroma pack comprises an aromatic insert, which is infused with a tobacco-like aroma, located within a housing positioned inside the aroma pack. The aromatic insert emits the scent of tobacco when the top cover of the pack is opened.

20 Claims, 6 Drawing Sheets

(56) References Cited

U.S. PATENT DOCUMENTS

| | | | |
|---|---|---|---|
| 2011/0180433 | A1 | 7/2011 | Rennecamp |
| 2011/0265806 | A1 | 11/2011 | Alarcon et al. |
| 2011/0315701 | A1 | 12/2011 | Everson |
| 2012/0227753 | A1 | 9/2012 | Newton |
| 2012/0267383 | A1 | 10/2012 | Van Rooyen |

OTHER PUBLICATIONS

English abstract of JP 2001-165437 A (1 page).

* cited by examiner

AROMA PACK FOR AN ELECTRONIC CIGARETTE

TECHNICAL FIELD

This disclosure generally relates to alternative smoking devices, and more particularly, to an aroma pack for an electronic cigarette.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with aspects of the present disclosure, components for an electronic cigarette pack are presented. The disclosure presents an aroma pack for an electronic cigarette configured to simulate the tobacco smell of a pack of traditional cigarettes.

In accordance with one embodiment of the present invention, an aroma pack is disclosed. The aroma pack comprises: an electronic cigarette package; an aromatic insert positioned within the electronic cigarette package; and wherein the aromatic insert has a tobacco-like scent.

In accordance with another embodiment of the present invention, an aroma pack is disclosed. The aroma pack comprises: an electronic cigarette package; an aromatic insert positioned within the electronic cigarette package; a housing; wherein the aromatic insert is positioned within the housing and wherein the housing is positioned within the electronic cigarette package; wherein the aromatic insert has a tobacco-like scent; and at least one electronic cigarette positioned within the electronic cigarette package.

In accordance with another embodiment of the present invention, an aroma pack is disclosed. The aroma pack comprises: an electronic cigarette package; an aromatic insert positioned within the electronic cigarette package; a housing; wherein the aromatic insert is positioned within the housing and wherein the housing is positioned within the electronic cigarette package; an evaporation port located on the housing; wherein the aromatic insert has a tobacco-like scent; and at least one electronic cigarette positioned within the electronic cigarette package.

BRIEF DESCRIPTION OF THE DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

Figure 1:
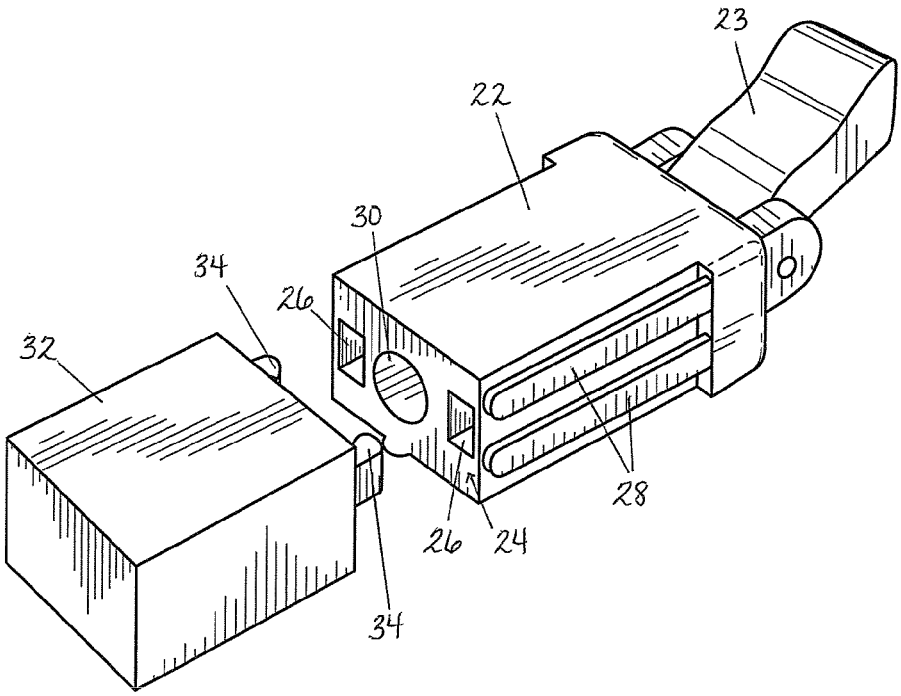
FIG. 1 is an elevated perspective view of a hinge assembly and housing for an aroma pack in accordance with one or more embodiments of the present invention. The hinge assembly and the housing are shown uncoupled.
Figure 2:
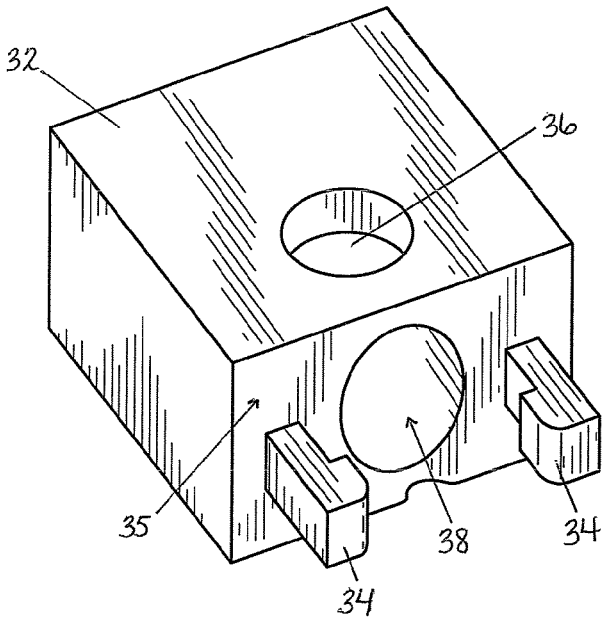
FIG. 2 is an elevated perspective view of the housing of FIG. 1.
Figure 3:
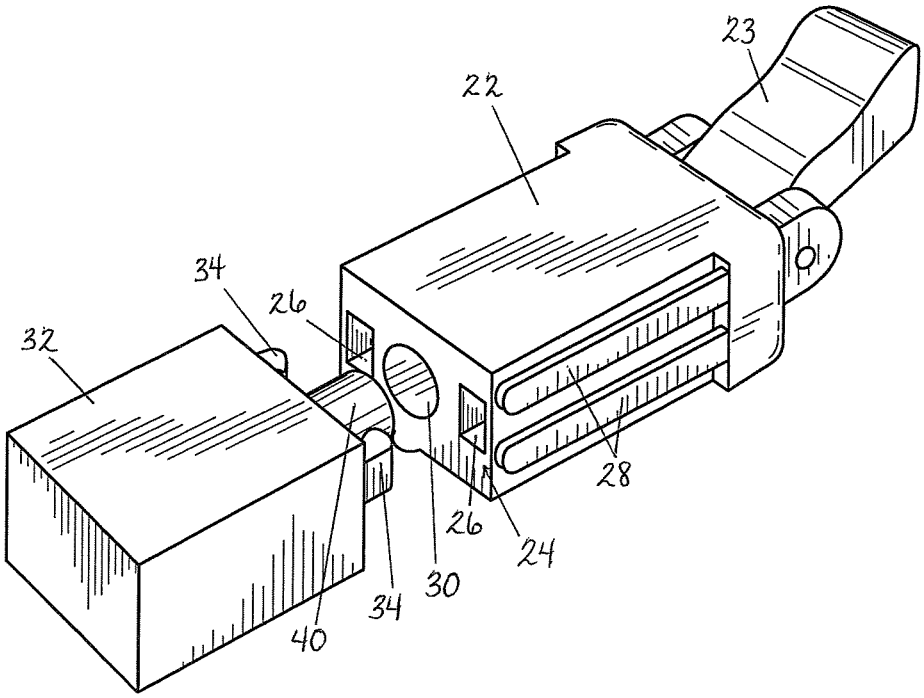
FIG. 3 is an elevated perspective view of a hinge assembly and housing for an aroma pack in accordance with one or more embodiments of the present invention. The hinge assembly and the housing are shown uncoupled and an aromatic insert is shown coupled within the housing.
Figure 4:
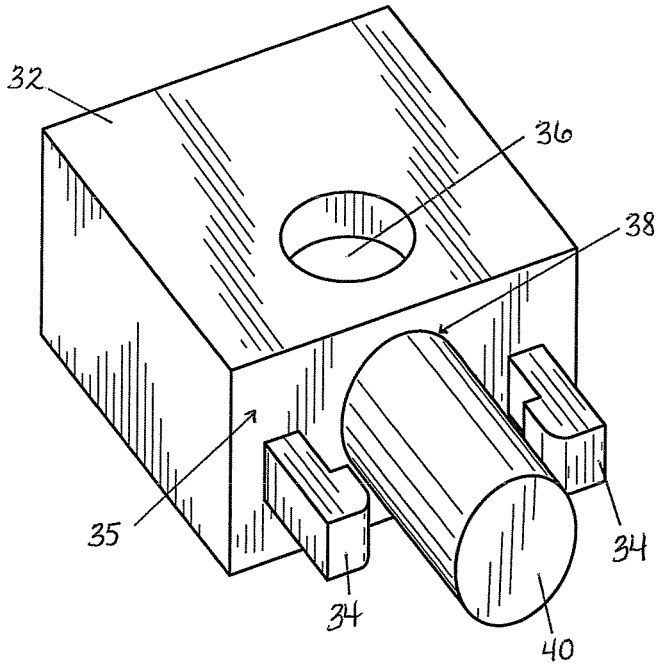
FIG. 4 is an elevated perspective view of the housing of FIG. 3 with the aromatic insert coupled within the housing.
Figure 5:
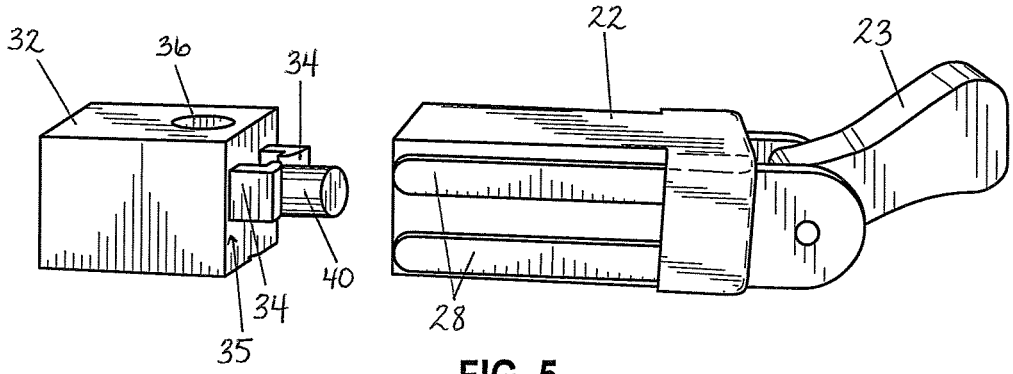
FIG. 5 is a side view of the hinge assembly and housing of FIG. 3.

The description set forth below is intended as a description of presently preferred embodiments of the disclosure and is not intended to represent the only forms in which the present disclosure can be constructed and/or utilized. The description sets forth the functions and the sequence of steps for constructing and operating the disclosure. It is to be understood, however, that the same or equivalent functions and sequences can be accomplished by different embodiments that are also intended to be encompassed within the spirit and scope of this disclosure.

The present disclosure generally relates to an aroma pack for electronic cigarettes. As will be disclosed, an aroma pack 10 for electronic cigarettes simulates the aroma of tobacco that is present in a traditional cigarette pack. A number of additional advantages will become apparent from the description provided below.

After removing the cellophane outer wrapper and foil cover from a pack of traditional cigarettes, one may smell the distinct scent of tobacco. The scent is emitted from the tobacco rods in the traditional cigarettes. Electronic cigarettes, however, typically contain no tobacco. The liquid that is vaporized within the electronic cigarette, and puffed by the user, may contain a tobacco aroma, but the scent is typically very faint. Therefore, when opening a typical electronic cigarette pack, the tobacco aroma is either very faint or nonexistent.

FIGS. 1 through 11 show an aroma pack for electronic cigarettes, hereinafter aroma pack 10, in accordance with one or more embodiments of the present invention. In one embodiment, the aroma pack 10 may comprise a package 12, a hinge assembly 22, and an aromatic insert 40. However, it should be noted that, depending on the construction of the package 12, a hinge assembly 22 may or may not be a necessary component. In one embodiment, the aromatic insert 40 may be provided without a hinge assembly 22, or in a configuration in which it is not coupled to a hinge assembly 22. It should be noted that the aromatic insert 40 is not itself a cigarette or electronic cigarette.

Referring to FIGS. 1-5, the hinge assembly 22 and a housing 32 are shown. (It should be noted that the housing 32 is also not itself a cigarette or electronic cigarette.) FIGS. 1-5 show that the hinge assembly 22 may comprise a cam spring, though any suitable hinge assembly 22 may be used. Although the hinge assembly 22 and the housing 32 are shown as to separate pieces coupled together, it should be clearly understood that that substantial benefit may be derived from the hinge assembly 22 and the housing 32 being integral to each other.

Figure 6:
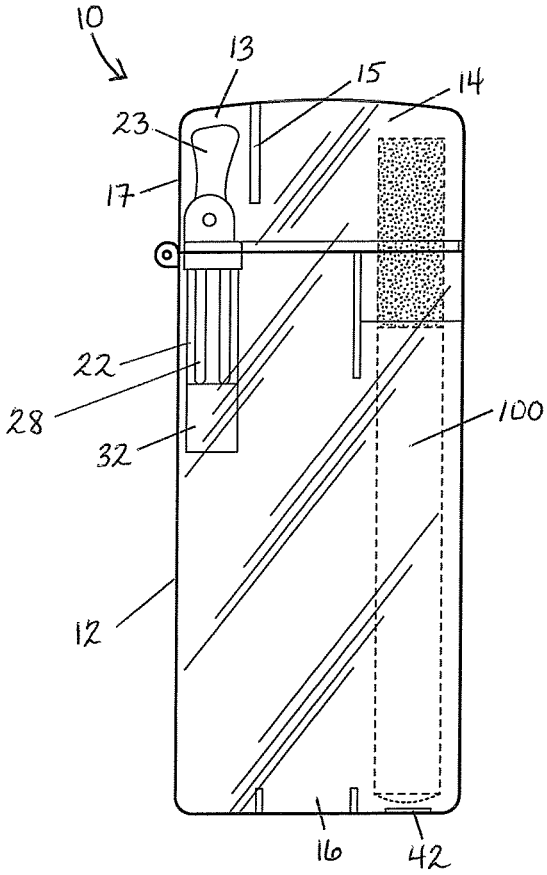
FIG. 6 is a front view of an aroma pack in accordance with one or more embodiments of the present invention. The aroma pack is shown with an electronic cigarette contained within the aroma pack.
Figure 7:
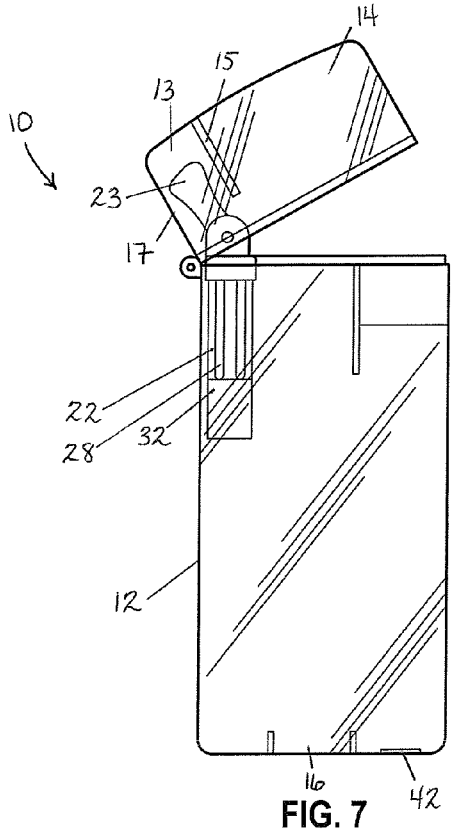
FIG. 7 is a front view of the aroma pack of FIG. 6 shown with the top cover partially open.
Figure 8:
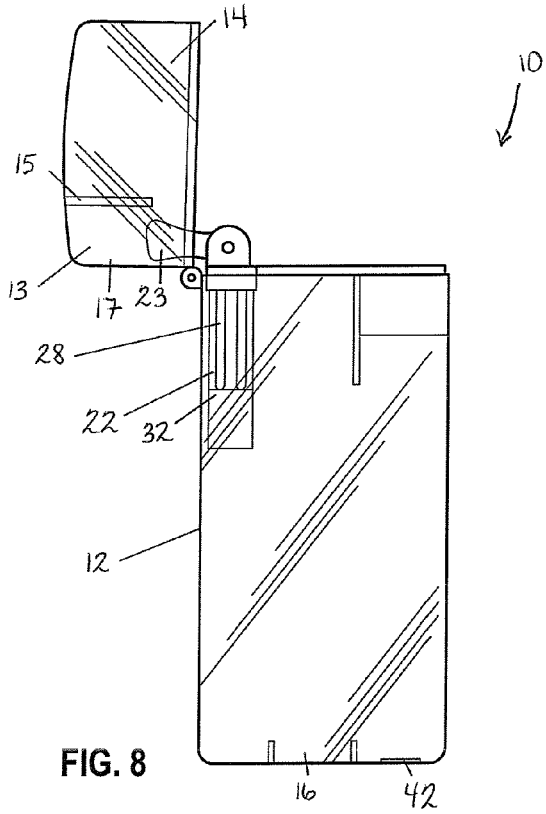
FIG. 8 is a front view of the aroma pack of FIG. 6 shown with the top cover half-way open.
Figure 9:
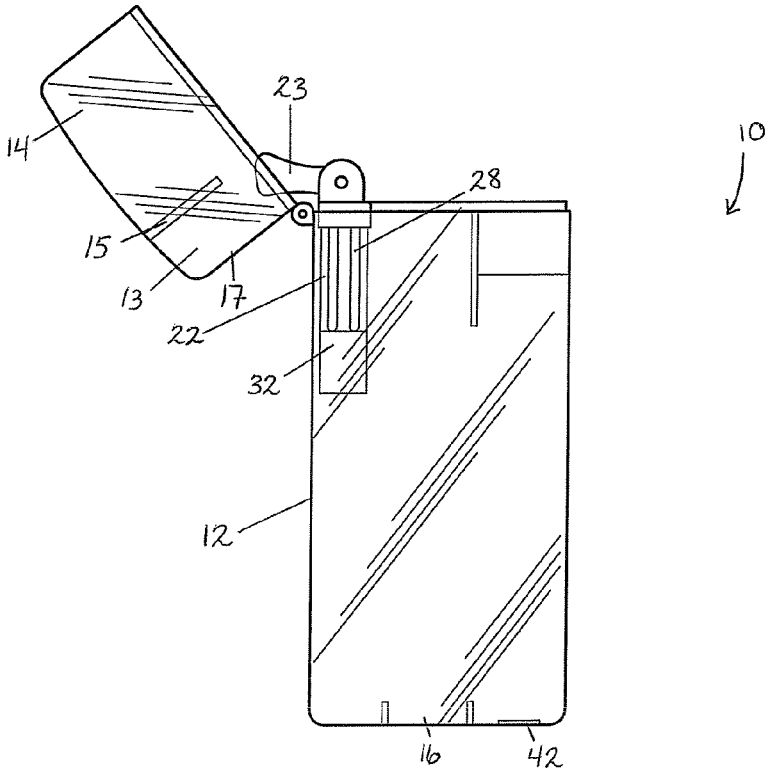
FIG. 9 is a front view of the aroma pack of FIG. 6 shown with the top cover open three-quarter way.
Figure 10:
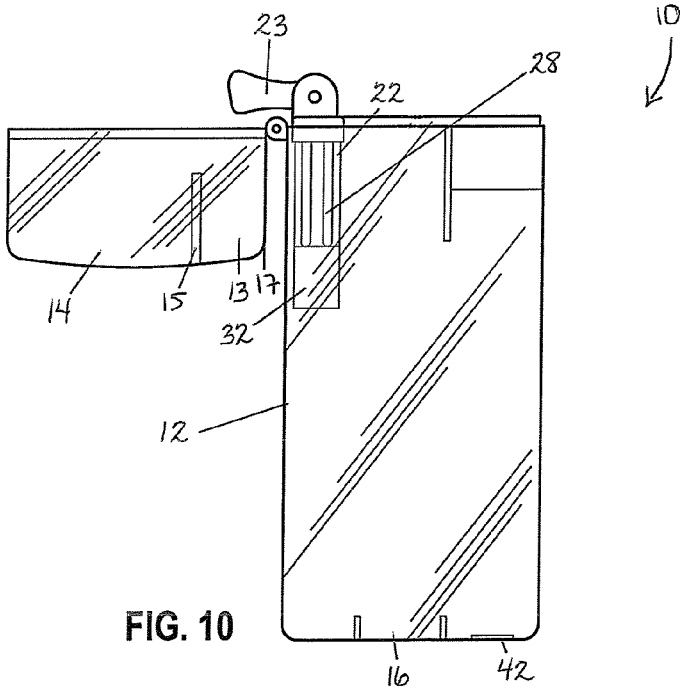
FIG. 10 is a front view of the aroma pack of FIG. 6 shown with the top cover completely open.

As shown in FIGS. 6-10, the hinge assembly 22 may be coupled within the package 12 and may have a lever 23 that engages a channel 13 defined by a top cover 14 of the package 12. Referring to FIG. 6, when the top cover 14 is in a closed position, the lever 23 of the hinge assembly 22 is in an upright position and may exert pressure upon a medial wall portion 15 of the channel 13 to help keep the top cover 14 in the closed position. Referring to FIGS. 7-9, when the top cover 14 is in an open position, the lever 23 of the hinge assembly 22 is in an angled position and may exert pressure upon a lateral wall portion 17 of the channel 13 to help keep the top cover 14 in the open position.

Figure 11:
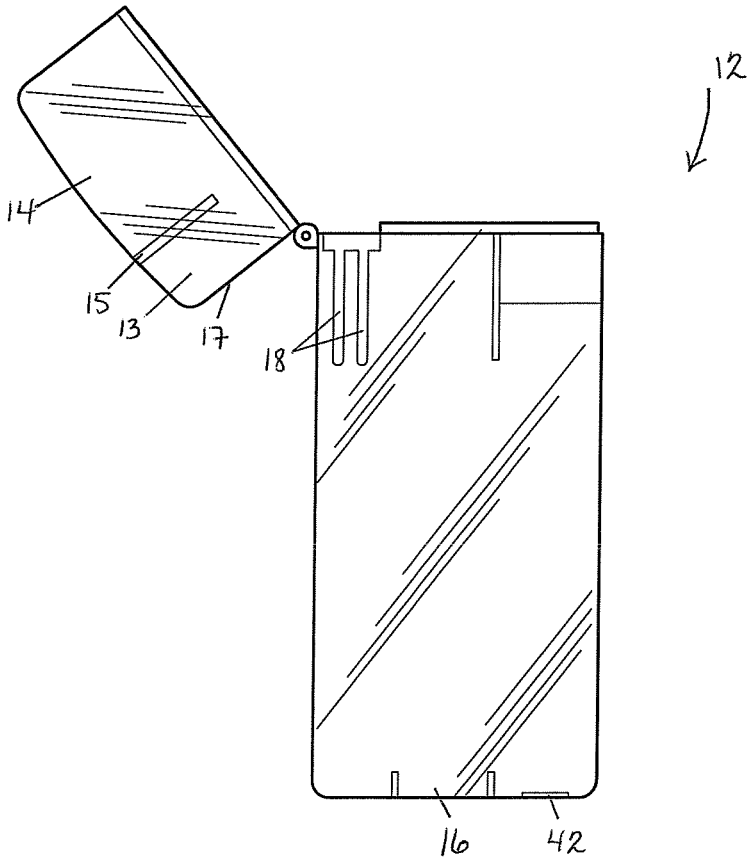
FIG. 11 is a front view of an aroma pack in accordance with one or more embodiments of the present invention. The aroma pack is shown with the top cover open three-quarter way and with the hinge assembly and housing removed.

The hinge assembly 22 may also have elongated flanges 28 along each of its sides. As shown in FIG. 11, the package 12 may have elongated channels 18 along its interior surface. The elongated flanges 28 of the hinge assembly 22 may be inserted into and slid within the elongated channels 18 on the interior surface of the package 12, thereby creating a tongue and groove connection to hold the hinge assembly 22 securely within the package 12. While it is shown that the elongated flanges 28 are formed along the sides of the hinge assembly 22 only, it should be clearly understood that substantial benefit may be derived from the elongated flanges 28 being formed along the sides of the housing 32 instead or from the elongated flanges 28 being formed along both the sides of the hinge assembly 22 and the sides of the housing 32 as well. It should also be clearly understood that while the aroma pack 10 is shown has having two tongue and groove connections, substantial benefit may still be derived from the use of an alternative number of tongue and groove connections or from the use of an alternative type of connection between the hinge assembly 22 and the package 12.

In an embodiment wherein the housing 32 and the hinge assembly 22 are separate components, the housing 32 may comprise two connection members 34 extending from a top surface 35 of the housing 32 and the hinge assembly 22 may have two corresponding apertures 26 formed within a bottom surface 24 of the hinge assembly 22. The connection members 34 engage the apertures 26 forming a male/female connection and thereby secure the housing 32 to the hinge assembly 22. While it is shown that the aroma pack 10 has two male/female connectors, it should be clearly understood that substantial benefit may be derived from an alternative number of male/female connectors or from the use of a different type of connection between the housing 32 and the hinge assembly 22.

The hinge assembly 22 may have an enclosed channel for containing the aromatic insert 40. The enclosed channel may be cylindrical in shape and may be formed by an aperture 38 in the top surface 35 of the housing 32 and by a corresponding aperture 30 formed in the bottom surface 24 of the hinge assembly 22 that aligns with the aperture 38 in the top surface 35 of the housing 32. It should be clearly understood, however, that the enclosed channel may have an alternative shape. It should also be clearly understood that the enclosed channel may be foamed entirely within the housing 32 or entirely within the hinge assembly 22.

The housing 32 may also have at least one (and optionally multiple) evaporation port 36. The evaporation port 36 may be positioned perpendicular to the enclosed channel and a bottom portion of the package 12 and may face the inner space of the package 12. The evaporation port 36 may have a diameter of approximately 2.9 mm. However, it should be clearly understood that substantial benefit may be derived from an evaporation port 36 having an alternative diameter. It should also be clearly understood that, although the evaporation port 36 is shown as being circular, it may have an alternative shape. The evaporation port 36 connects to the enclosed channel and exposes the aromatic insert 40 within the enclosed channel, allowing aroma from the aromatic insert 40 to escape the housing 32 and to circulate throughout the package 12. The enclosed channel helps to keep the aromatic insert 40 contained and isolated from the rest of the aroma pack 10 (to prevent leakage and/or contamination of the electronic cigarette 100 stored within the aroma pack 10) and the size of the evaporation port 36 is preferably relatively small to help prevent over-drying of the aromatic insert 40.

The aromatic insert 40 may comprise compressed cotton fiber or any other suitable material such as paper, blotter, or absorbent. The aromatic insert 40 may be treated, soaked, infused, saturated or otherwise exposed or brought into contact with aromatic liquid having a tobacco-like scent and may be so treated either before or after its insertion into the housing 32. (It should be noting that, preferably, the aromatic liquid contains no tobacco and the tobacco-like scent is artificial, but it would be possible to utilize actual tobacco in the formulation of the aromatic liquid. It should also be noted that, rather than a liquid, the aroma source within the housing 32 may be in a solid form.) Upon opening the aroma pack 10, the user will detect the tobacco aroma. It should be clearly understood that the aroma may be of tobacco or of any other desired aroma.

The aroma pack 10 may also have an ethylene-vinyl acetate (EVA) foam disc 42 coupled to the interior surface of a bottom portion 16 of package 12. It should be clearly understood that substantial benefit may still be derived from the foam disc having any other shape or being made of any other suitable material. The foam disc 42 may ideally be positioned below the electronic cigarette 100 (shown in FIG. 6) when the electronic cigarette 100 is stored within the aroma pack 10. The foam disc 42 may have a diameter of approximately 7 mm, but it should be clearly understood that substantial benefit may be derived from an alternative size. When the electronic cigarette 100 is placed within the aroma pack 10, the foam disc 42 may absorb approximately 0.44 mm of tolerance and will help to prevent the electronic cigarette 100 from jostling within the aroma pack 10 during transport, thereby protecting its internal components.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public.

I claim:

1. An aroma pack for an electronic cigarette comprising:

an electronic cigarette package; and an aromatic insert positioned within a housing, wherein the housing is coupled to a hinge assembly coupled within the electronic cigarette package, and wherein the hinge assembly has an upper portion hinged to a lower portion, the lower portion coupled to the housing;

wherein the aromatic insert has tobacco scent.

2. The aroma pack of claim 1 further comprising at least one evaporation port located on the housing.

3. The aroma pack of claim 2 wherein the evaporation port is perpendicular to a bottom portion of the electronic cigarette package.

4. The aromatic pack of claim 2 wherein the at least one evaporation port has a diameter of approximately 2.9 mm.

5. The aroma pack of claim 1 wherein the housing is positioned within a channel within the electronic cigarette package.

6. The aroma pack of claim 1 wherein the aromatic insert comprises a compressed cotton fiber comprising an aromatic liquid.

7. The aroma pack of claim 1 further comprising at least one electronic cigarette positioned within the electronic cigarette package.

8. The aroma pack of claim 1, wherein the upper portion of the hinge assembly includes a lever.

9. The aroma pack of claim 1, wherein the hinge assembly includes a plurality of elongated flanges, and wherein an interior surface of the electronic cigarette package includes a plurality of elongated channels for receiving the plurality of elongated flanges.

10. The aroma pack of claim 1, wherein the housing is coupled to a bottom surface of the hinge assembly.

11. An aroma pack for an electronic cigarette comprising:

an electronic cigarette package;

a hinge assembly coupled within the electronic cigarette package, the hinge assembly having an upper portion hinged to a lower portion;

a housing coupled to the lower portion;

an aromatic insert positioned within the housing; and at least one electronic cigarette positioned within the electronic cigarette package.

12. The aroma pack of claim 11 further comprising at least one evaporation port located on the housing.

13. The aroma pack of claim 12 wherein the at least one evaporation port is perpendicular to a bottom portion of the electronic cigarette package.

14. The aroma pack of claim 11 wherein the housing is positioned within a channel within the electronic cigarette package.

15. The aroma pack of claim 11 wherein the aromatic insert comprises a compressed cotton fiber comprising an aromatic liquid.

16. The aroma pack of claim 11, wherein the aromatic insert has a tobacco scent.

17. An aroma pack for an electronic cigarette comprising:

an electronic cigarette package;

an aromatic insert positioned within a housing, wherein the housing is coupled to a hinge assembly coupled within the electronic cigarette package, and wherein the hinge assembly has an upper portion hinged to a lower portion, the lower portion coupled to the housing;

at least one evaporation port located on the housing; and at least one electronic cigarette positioned within the electronic cigarette package;

wherein the aromatic insert has a tobacco scent.

18. The aroma pack of claim 17 wherein the housing is positioned within a channel within the electronic cigarette package.

19. The aroma pack of claim 17 wherein the aromatic insert comprises a compressed cotton fiber comprising an aromatic liquid.

20. The aroma pack of claim 17 wherein the at least one evaporation port is perpendicular to a bottom portion of the electronic cigarette package.

* * * * *